US006210527B1

(12) United States Patent
Kirschner et al.

(10) Patent No.: US 6,210,527 B1
(45) Date of Patent: Apr. 3, 2001

(54) PULP BLEACHING METHOD WHEREIN AN OZONE BLEACHING WASTE STREAM IS SCRUBBED TO FORM AN OXYGEN CONTAINING STREAM

(75) Inventors: Mark J. Kirschner, Morristown; Rustam H. Sethna, New Brunswick, both of NJ (US)

(73) Assignee: The BOC Group, Inc., New Providence, NJ (US)

( * ) Notice: Subject to any disclaimer, the term of this patent is extended or adjusted under 35 U.S.C. 154(b) by 0 days.

(21) Appl. No.: 08/213,290

(22) Filed: Mar. 14, 1994

(51) Int. Cl.[7] ..... D21C 11/04

(52) U.S. Cl. ..... 162/29; 162/38; 162/40; 162/65; 162/82

(58) Field of Search ..... 162/15, 16, 29, 162/38, 30.1, 30.11, 65, 39, 40, 82

(56) References Cited

U.S. PATENT DOCUMENTS

| | | | |
|---|---|---|---|
| 3,860,479 | 1/1975 | Barker et al. | 162/79 |
| 3,963,561 | 6/1976 | Richter | 162/17 |
| 4,053,352 | 10/1977 | Hultman et al. | 162/29 |
| 4,131,508 | 12/1978 | Laakso | 162/30 |
| 4,161,421 | 7/1979 | Sherman | 162/18 |
| 4,172,006 | 10/1979 | San Clemente | 162/65 |
| 4,372,812 | 2/1983 | Phillips et al. | 162/40 |
| 4,450,044 | 5/1984 | Fritzvold et al. | 162/65 |
| 4,595,455 | 6/1986 | Mannbro | 162/38 |
| 4,619,733 | 10/1986 | Kooi | 162/30.1 |
| 4,834,837 | 5/1989 | Loquenz et al. | 162/19 |
| 4,855,123 | 8/1989 | Suzuki et al. | 423/562 |
| 4,895,619 | 1/1990 | Ahs et al. | 162/55 |
| 4,902,381 | 2/1990 | Meredith | 162/65 |
| 5,145,557 | 9/1992 | Peter et al. | 162/40 |
| 5,164,043 | 11/1992 | Griggs et al. | 162/57 |
| 5,179,021 | 1/1993 | du Manoir et al. | 435/278 |
| 5,296,097 * | 3/1994 | Friend | 162/65 |

OTHER PUBLICATIONS

G.H. Homer et al., Ozone and Oxygen Supply for the Bleaching of Pulp, Presented at te Non–Chlorine Bleaching Conference, Hilton Head, SC, Mar., 1993.

(List continued on next page.)

*Primary Examiner*—Steve Alvo
(74) *Attorney, Agent, or Firm*—Salvatore P. Pace

(57) ABSTRACT

A method for producing bleached wood pulp in which wood chips are digested in polysulfide liquor to produce brown stock pulp. The brown stock pulp is washed to produce washed brown stock wood pulp and weak black liquor and the washed wood pulp is then delignified in an oxygen delignification stage to produce oxygen delignified wood pulp. The delignified wood pulp is then ozone bleached in an ozone bleaching stage in which a waste stream principally containing ozone, carbon dioxide and oxygen is produced. The ozone-bleached pulp is introduced into an extractive oxidation stage which can include peroxide to further bleach the pulp and the product of the extractive oxidation stage is then either introduced into either a peroxide or chlorine dioxide bleaching stage. The waste stream is recovered and scrubbed with either white liquor, oxidized white liquor, or fully oxidized white liquor either in a separate scrubber or during oxidation reactions occurring in either polysulfide, white liquor or complete white liquor production stages. The scrubbing with white liquor or oxidized white liquor removes ozone and carbon dioxide so that the scrubbed stream can be utilized in the oxygen delignification stage. This eliminates the need for ozone destruct units. Moreover, the polysulfide liquor is utilized in the digestion of the wood pulp and the thiosulfate liquor is used in the oxygen delignification of the washed wood pulp. The fully oxidized white liquor can be utilized within the extractive oxidation stage and optionally can be used in a peroxide bleaching stage if present. The oxygen removed from the scrubbed stream can be balanced with oxygen demand of the foregoing stages.

7 Claims, 3 Drawing Sheets

OTHER PUBLICATIONS

N. Soteland, Bleaching of Chemical Pulps With Oxygen and Ozone, Presented at the 6th International Pulp Bleaching Conference, Vancouver Canada, Jun. 3–7, 1973, pp. 117–126.

M.A. Pikulin et al., High Consistency Ozone Bleaching: Commercial Implementation,Presented at the Non–Chlorine Bleaching Conference, Hilton Head, SC, Mar., 1993.

* cited by examiner

PULP BLEACHING METHOD WHEREIN AN OZONE BLEACHING WASTE STREAM IS SCRUBBED TO FORM AN OXYGEN CONTAINING STREAM

BACKGROUND OF THE INVENTION

The present invention relates to a method of producing bleached wood pulp in which wood chips are digested and are then subjected to subsequent bleaching stages that are conducted in the presence of a sodium hydroxide. More particularly the present invention relates to such a method that includes an ozone bleaching stage in which a waste stream produced from an ozone bleaching stage is scrubbed to produce an oxygen containing stream useful in an oxygen delignification stage of the pulping process. Even more particularly, the present invention relates to such a method in which the waste stream is scrubbed by white liquor either in an external stage or during production of polysulfide liquor and then is separately reacted with white liquor to produce oxidized white liquor containing an appreciable amount of thiosulfate species of sulfur (thiosulfate liquor), and fully oxidized white liquor, containing almost no thiosulfate sulfur, to serve as sodium hydroxide in bleaching stages.

In the formation of bleached wood pulp, wood chips are digested in the presence of white liquor, which contains sodium sulfide and sodium hydroxide for such digestion, to produce brownstock pulp and weak black liquor. It is known that pulping with polysulfide liquor has advantages over conventional white liquor cooking in the wood chip digestion stage. The brownstock pulp is then washed and weak black liquor is extracted for reprocessing. The pulp is then subjected to oxygen delignification. The oxygen delignification is conducted in the presence of thiosulfate liquor, oxygen and steam. After the oxygen delignification, the wood pulp is sequentially subjected to an ozone bleaching stage, an extractive oxidation stage, which may be conducted in the presence of peroxide, and a final peroxide or chlorine dioxide bleaching stage. The extractive oxidation stage is conducted in the presence of thiosulfate liquor. Fully oxidized white liquor is a sodium hydroxide source for peroxide based bleaching stages and has advantages in such bleaching stages over thiosulfate liquor.

The ozone feed to the ozone bleaching stage is made in an ozone generator from air or more preferably oxygen. The end result is a mixture of ozone and oxygen containing about 5% ozone if air is used and anywhere from 10 to 14% ozone if the ozone is generated from oxygen. Not all of the feed to the ozone bleaching stage is consumed and as a result, a waste stream is produced that contains ozone, oxygen, carbon dioxide and water. This waste stream is further processed by an ozone destruct unit and a carbon dioxide scrubber to produce oxygen that can be used in an oxygen deliqnification stage. Ozone is destroyed so that the stream may be recycled to the ozone generator after $CO_2$ removal and drying. Also, some of the waste stream may be vented atmosphere and ozone must be destroyed for industrial hygienic reasons. Carbon dioxide must be removed, otherwise it would consume sodium hydroxide inside the oxygen delignification stage, limiting the extent of lignin removal.

As will be discussed, the present invention provides a method of producing bleached wood pulp in which a waste stream produced from an ozone bleaching stage is scrubbed and then used as a source of oxygen for oxygen delignification. Expensive ozone destruct units are not used and in fact oxygen requirements can be balanced with oxygen recovery from the waste stream. The implication of this is that an oxygen recycle involved in the utilization of the ozone destruct unit can be eliminated together with its attendant capital and power consumption. Additionally, there is no need to further purify the waste stream to remove carbon dioxide and water. Moreover, the present invention advantageously utilizes polysulfide liquor in the wood chip digestion stage, oxidized white liquor in oxygen delignification and extractive oxidation stages, and fully oxidized white liquor in the peroxide bleaching stage.

SUMMARY OF THE INVENTION

The present invention provides a method of producing bleached wood pulp. In accordance with the method, wood chips are digested in a digestion stage to produce brownstock pulp and weak black liquor. The brownstock pulp is washed and the weak black liquor is extracted. The brownstock pulp after having been washed is introduced into sequential bleaching stages, including oxygen delignification and ozone bleaching stages, to produce a bleached wood pulp product. The oxygen delignification stage utilizes an oxygen containing stream and the ozone bleaching stage utilizes an ozone/oxygen containing stream. The ozone bleaching stage produces a waste stream principally containing water vapor, carbon dioxide, ozone, and oxygen. The waste stream is recovered and scrubbed with an aqueous, sodium sulfide and sodium hydroxide containing solution to remove ozone and carbon dioxide from the waste stream and thereby form a scrubbed stream. The oxygen containing stream, used in the oxygen delignification stage, is formed from at least part of the scrubbed stream.

Residual ozone is consumed from the waste stream by oxidizing sodium sulfide to an oxygenated sulfur species such as sulfite, thiosulfate or sulfate. Sodium hydroxide reacts with carbon dioxide to form sodium carbonate. In this manner, the waste stream becomes a scrubbed stream to eliminate the need for an ozone destruct unit. Additionally, since carbon dioxide has been removed, it will not neutralize the alkalinity required in the oxygen deliqnification process. Furthermore, in another aspect of the present invention, that will be discussed hereinafter, the oxygen recovered from the waste stream can be balanced with oxygen usage by utilizing the waste stream as an oxidant in a polysulfide production stage. Such usage will scrub the waste stream and will produce polysulfide that can be advantageously used in the wood chip digestion stage. Furthermore, the resultant scrubbed stream can also be used in oxidizing and fully oxidizing the white liquor in oxidized white liquor and fully oxidized white liquor stages. The fully oxidized white liquor can also advantageously be used in a peroxide based bleaching stage.

BRIEF DESCRIPTION OF THE DRAWINGS

While the specification concludes with claims distinctly pointing out the subject matter that Applicants regard as their invention, it is believed that the invention will be better understood when taken in connection with the accompanying drawings in which:

DETAILED DESCRIPTION

Figure 1:
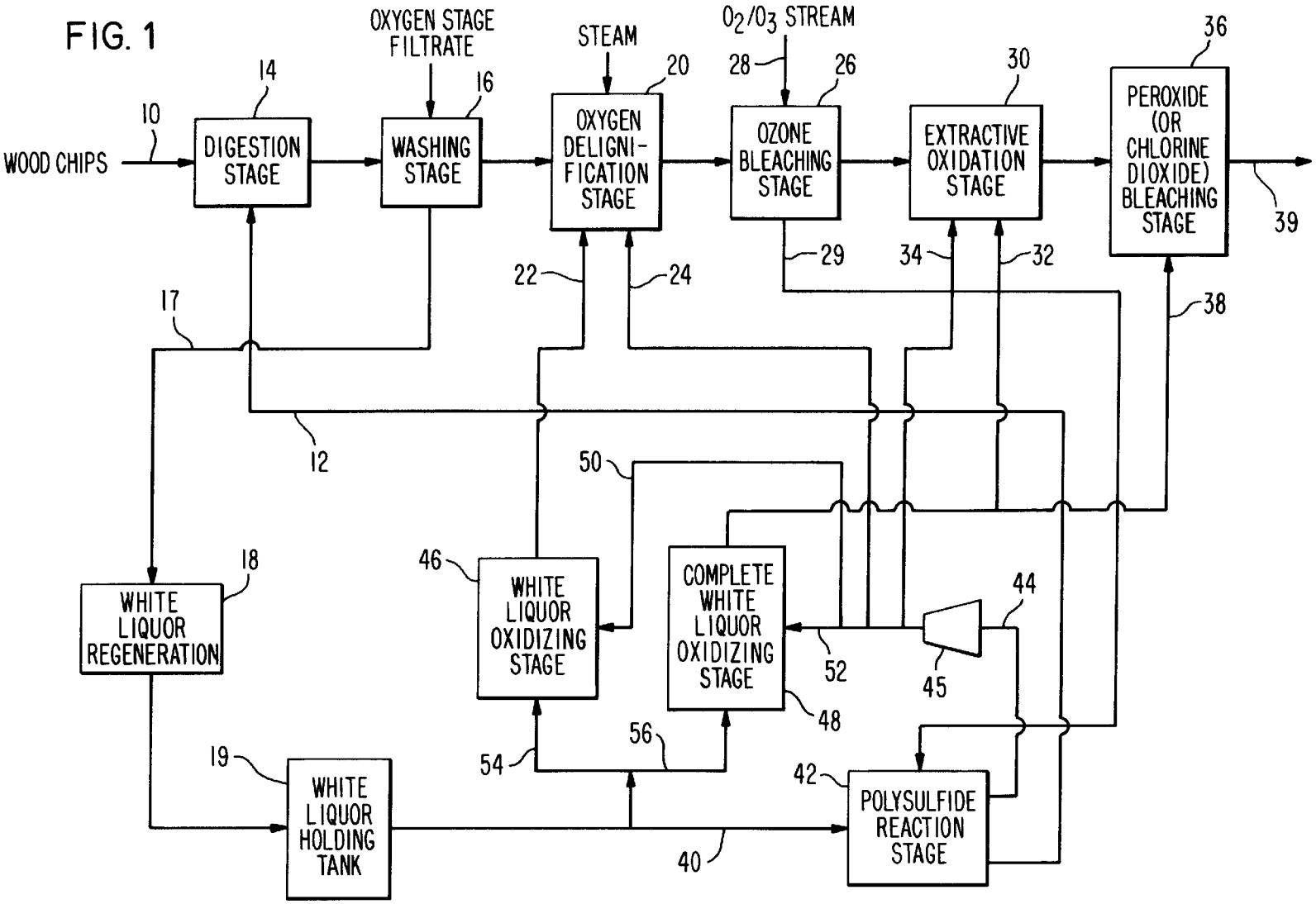
FIG. 1 is a schematic representation of a method of producing bleached wood pulp in accordance with the present invention.

With reference to FIG. 1, a process flow sheet of a method for producing bleached wood pulp is illustrated. Wood chips 10 and a polysulfide liquor stream 12 enter a digestion stage 14, which can be provided by a known wood pulp digester, to produce brownstock pulp and weak black liquor. The brownstock pulp is introduced into a washing stage 16, which can be a rotary washer, along with oxygen stage filtrate. The brownstock pulp is washed with the water and the weak black liquor is extracted as a weak black liquor stream 17. Although not illustrated but as would be known to those skilled in the art that digestion and washing stages 14 and 16 could be integrated and generally could also include a knotting stage separating the digestion and washing stages 14 and 16 and a screening stage following washing stage 16.

Weak black liquor stream can be processed in a manner well known in the art to produce white liquor. This is accomplished by introducing the weak black liquor into multiple effect evaporators and a recovery boiler to convert the weak black liquor to smelt. The smelt is then dissolved in a dissolving tank to produce green liquor. The green liquor is then causticized in a causticizing tank by the addition of lime from a lime kiln and is then subjected to a clarifying stage to produce the white liquor. All of these stages, which are known in the art, are designated by white liquor regeneration stage 18. White liquor from white liquor regeneration stage 18 can be held for use within a holding tank 19. It is to be noted that although not illustrated, washers would be placed between each of the stages with countercurrent flow of washer filtrate from washer to washer and then back to washing stage 16. This is the manner in which oxygen stage filtrate is obtained for washing stage 16. At the same time, the weak black liquor is being reprocessed to form white liquor which is in turn used throughout the bleaching process. It is to be noted that a mass balance can be maintained throughout the mill without the resort found in the prior art of adding sodium hydroxide. When sodium hydroxide is added, it can potentially build and thus be discharged from the mill.

The brownstock pulp is then introduced into an oxygen delignification stage 20 along with steam and a thiosulfate liquor stream 22 and a first oxygen containing stream 24. The oxygen delignification stage 20 would be provided by a reactor, known in the art. The delignified wood pulp is then introduced into an ozone bleaching stage 26 along with an ozone/oxygen containing stream 28 to produce an ozone-bleached pulp and a waste stream 29. The ozone-bleached pulp and a second oxygen-containing stream 28 is then introduced into a known extractive oxidation stage 30 along with a first fully oxidized white liquor stream 32 and a second oxygen containing stream 34. The extractive oxidation stage is provided to remove soluble alkaline reaction products produced in ozone bleaching stage 26. In the illustrated process, extractive oxidation stage 30 utilizes peroxide (the stream containing peroxide is not illustrated). It is to be noted that in some extractive oxidation processes peroxide is not utilized. In this regard, first fully oxidized white liquor stream 32 is optional because it is only required when peroxide is present within extractive oxidation stage 30. When peroxide is not present, thiosulfate liquor may be substituted for fully oxidized white liquor. The ozone bleached pulp produced in extractive oxidation stage 30 is then introduced into a known peroxide bleaching stage 36 along with a second fully white oxidized liquor stream 38 to produce a bleached wood pulp product 39. Alternatively, a chlorine dioxide bleaching stage could be used in place of the peroxide bleaching stage. In such case, second fully oxidized white liquor stream 38 would not be used.

Waste stream 29 from the ozone bleaching stage 26 is then introduced along with a subsidiary stream 40 composed of white liquor into a polysulfide reaction stage 42. Polysulfide reaction stage 42 can be a stirred tank, a pipeline reactor or a device using counter-current contact devices such as structured packing. In any of these reactors, the white liquor serves to strip the carbon dioxide from the waste stream while the white liquor is oxidized by the oxygen contained within waste stream 29 to produce the polysulfide liquor. The sulfide reactions remove ozone. Thus, waste stream 29 is introduced into polysulfide reaction stage 42 as a third oxygen containing stream which becomes scrubbed with respect to carbon dioxide and ozone to become scrubbed stream 44.

Scrubbed stream 44 is then compressed by a compressor 45 to an elevated pressure at which oxygen delignification stage 20, white liquor and complete white liquor oxidizing stages, designated by reference numbers 46 and 48, operate. These foregoing stages operate at an elevated pressure as compared with the remainder of the apparatus illustrated in FIG. 1. After compression, scrubbed stream 44 is subdivided into first and second oxygen containing streams 24 and 34 and a forth and a fifth oxygen containing streams 50 and 52 which are then introduced into white liquor and complete white liquor oxidizing stages 46 and 48, respectively, along with two other subsidiary streams 54 and 56 containing white liquor. Thiosulfate liquor is produced in white liquor oxidizing stage 46 and fully oxidized white liquor is produced in complete white liquor oxidizing stage 48 which in turn respectively serve as makeup for thiosulfate liquor stream 22 and first and second fully oxidized white liquor streams 32 and 38.

As possible alternative embodiments, either thiosulfate liquor, white liquor, or fully oxidized white liquor could be used as an alkaline, aqueous solution to scrub carbon dioxide from waste stream 29. In such alternative embodiments, waste stream 29 could be used as either the forth or fifth oxygen containing streams 50 and 52 to produce a scrubbed stream emanating from either white liquor and complete white liquor oxidizing stages 46 and 48. Thereafter, such scrubbed stream would be subdivided into first and second oxygen containing streams 24 and 34, a third oxygen containing stream to be introduced into polysulfide reaction stage 42 and either the remaining forth or fifth oxygen containing streams 50 and 52 which was not formed by waste stream 29. As could be appreciated, in any of the foregoing embodiments in which waste stream 29 is used to directly form either fourth or fifth oxygen containing streams 50 and 52, waste stream 29 must be compressed to the elevated operating pressure of white liquor and complete white liquor oxidizing stages 46 and 48. For that matter, in any possible embodiment of the present invention, waste stream 29 could be compressed in lieu of compressing the scrubbed stream.

The oxygen requirements of a method in accordance with the present invention, such as outlined above, will depend upon whether the final bleaching stage is a peroxide bleaching stage or a chlorine dioxide bleaching stage. Chlorine dioxide bleaching is an acidic process that does not consume oxidized white liquor or oxygen and as such will not consume oxygen. Additionally, the amount of polysulfide produced will also effect oxygen consumption. On the supply side, the amount of oxygen produced will depend on the ozone requirements in the ozone bleaching stage. The greater the requirement for ozone, the greater will be the oxygen production. The following is a calculated chart of oxygen production versus usage is a process conducted in accordance with the present invention as set forth in FIG. 1. In the first column, the term, "W % $O_3$" means the percentage by weight ozone in the ozone/oxygen containing stream produced by the ozone generator and used in ozone bleaching stage 26. The term "$O_3$ charge on pulp" is the ozone requirement for the particular pulp being bleached. The next column, headed, "$O_2$ produced from $O_3$ gen" is the oxygen content in the ozone/oxygen containing stream. Under the grouping "oxygen Usage in Mill, the "%PS as S" is the percentage poly sulfide charge on the pulp expressed as sulfur. "PS-$OZE_{op}$-P" indicates the use of a peroxide bleaching stage with an extractive oxidation stage using peroxide. "PS-$OZE_{op}$-D" indicates a chlorine dioxide bleaching stage. For comparison purposes, the oxygen usage of a prior art pulp bleaching process that does not use polysulfide is labeled, "No PS".

OXYGEN REQUIREMENTS FOR 1000 MFPD O.D. PULP

| Wt. % $O_3$ | $O_3$ charge on pulp (% wt.) | $O_2$ produced from $O_3$ gen mtpd | Oxygen Usage in Mill: 2% PS as S PS-$OZE_{OP}$-P | 2% PS as S PS-$OZE_{OP}$D | 1% PS as S PS-$OZE_{OP}$-P | 1% PS as S PS-$OZE_{OP}$D |
|---|---|---|---|---|---|---|
| 10 | 0.8 | 72 | 72 | 60 | 64 | 52 |
| 10 | 1.0 | 90 | 72 | 60 | 64 | 52 |
| 12 | 0.8 | 59 | 72 | 60 | 64 | 52 |
| 12 | 1.0 | 73 | 72 | 60 | 64 | 52 |
| 14 | 0.8 | 49 | 72 | 60 | 64 | 52 |
| 14 | 1.0 | 61 | 72 | 60 | 64 | 52 |

OXYGEN REQUIREMENTS FOR 1000 MTPD 0.D. PULP
Oxygen Usage in Mill

| Wt. % $O_3$ | $O_3$ charge on pulp (% wt.) | $O_2$ produced from $O_3$ gen mtpd | No PS: PS-$OZE_{OP}$-P | No PS: PS-$OZE_{OP}$D |
|---|---|---|---|---|
| 10 | 0.8 | 72 | 57 | 45 |
| 10 | 1.0 | 90 | 57 | 45 |
| 12 | 0.8 | 59 | 57 | 45 |
| 12 | 1.0 | 73 | 57 | 45 |
| 14 | 0.8 | 49 | 57 | 45 |
| 14 | 1.0 | 61 | 57 | 45 |

As indicated by the charts, oxygen usage can be balanced. Also, under certain circumstances, the combination of ozone output and ozone charge required will not produce enough oxygen to sustain a process in accordance with the present invention. For instance, where the weight percent ozone in the ozone/oxygen containing stream 12 and the required ozone charge on the pulp is 0.8, then the 59 kg of oxygen per metric ton per day of oven dried pulp would only be sufficient to sustain a process in accordance with the present invention in which a chlorine dioxide bleaching stage were used and with a polysulfide stage that produced 1% sulfur in the polysulfide.

Figure 2:
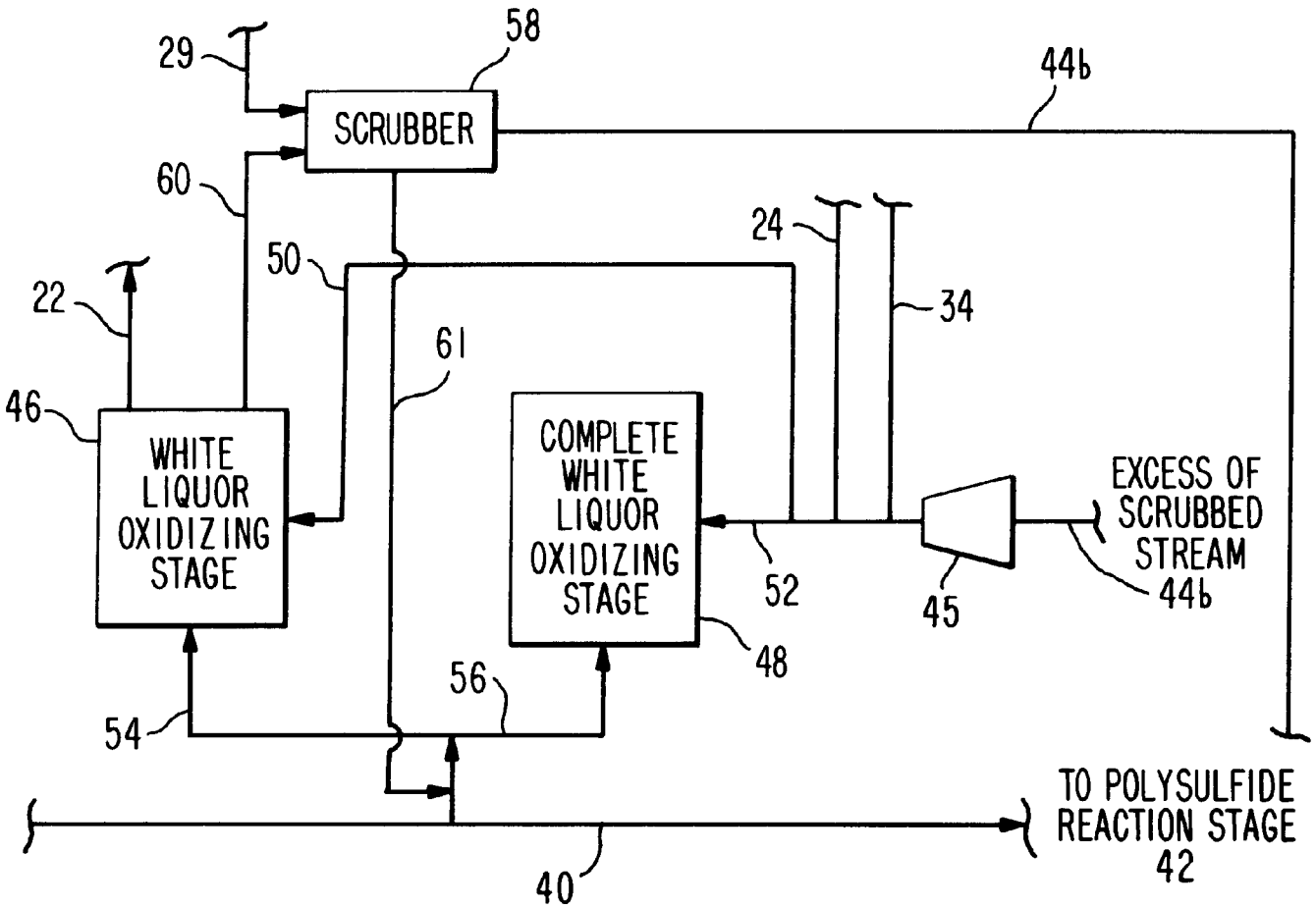
FIG. 2 is a schematic view of an alternative embodiment of a method of producing bleached wood pulp in accordance with the present invention.

With reference to FIG. 2, waste stream 29 can be scrubbed within a scrubbing stage 58 by a partial stream 60 formed of thiosulfate liquor produced within white liquor oxidizing stage 46 to form a scrubbed stream **44*b* which is then introduced into polysulfide reaction stage 42 as the third oxygen containing stream. The excess of scrubbed stream 44*b* not used within polysulfide reaction stage 42 is then subdivided into first and second oxygen containing streams 24 and 34 and forth and fifth oxygen containing streams 50 and 52. The thiosulfate liquor after having served its scrubbing function is returned as a recycled thiosulfate stream 61 which is added to the white liquor and used in forming subsidiary streams 54 and 56**.

Alternatively, partial stream 60 could be formed of fully oxidized white liquor from complete white liquor oxidizing stage 48, white liquor, or polysulfide liquor from polysulfide reaction stage 42. If fully oxidized white liquor is used, only carbon dioxide will be removed. No ozone destruct tubes place. As a result the residual ozone would eventually be consumed. This would not be preferred because the ozone would adversely effect conventional equipment and fittings. The resultant scrubbed stream could then again be introduced into polysulfide reaction stage 42 with the excess being subdivided into first and second oxygen containing streams 24 and 34, the third oxygen containing stream, and forth and fifth oxygen containing streams 50 and 52. A further alternate is that scrubbed stream **44*b* could be compressed and introduced into either white liquor or complete white liquor oxidizing stage 46 or 48 and then, the excess subdivided into first and second oxygen containing streams 24 and 34, the third oxygen containing stream, and either the forth or fifth oxygen containing stream 50 and 52. As is apparent from the above discussion, in the embodiment of FIG. 2**, the scrubbed stream is being used to form all oxygen containing streams.

Figure 3:
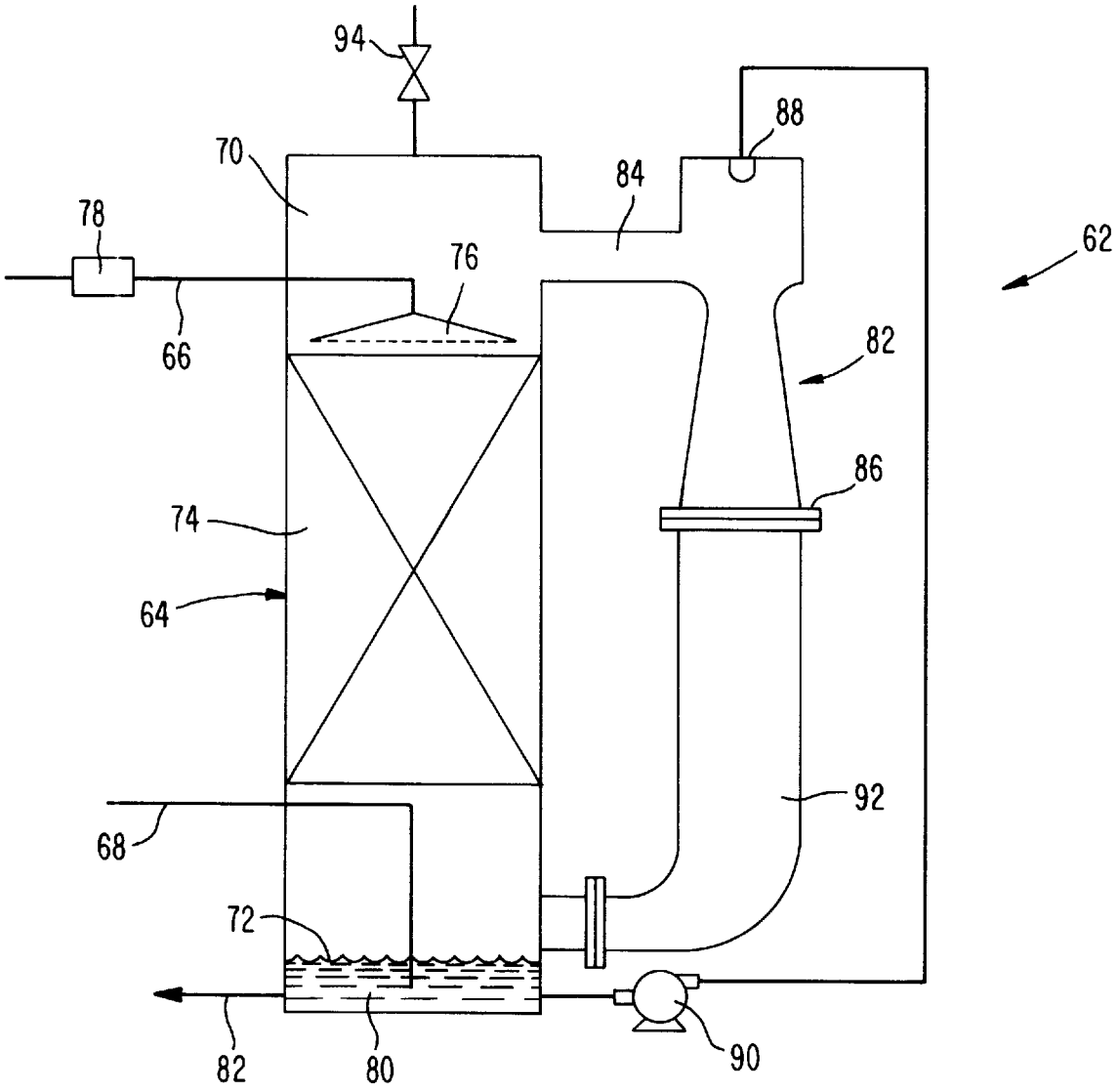
FIG. 3 is a schematic of a reactor used in producing fully oxidized white liquor.

With reference to FIG. 3, a preferred fully oxidized white liquor reactor 62 is illustrated. Reactor 62 consists of a liquid/vapor contacting column 64 of approximately 9.84 meters in height by about 0.9 meters in diameter. Column 64 is provided with an a white liquor inlet 66 and an oxygen inlet 68 to top and bottom regions 70 and 72 of column 64, respectively. An oxygen stream is introduced into the column through inlet 66 and a white liquor stream is introduced into the column through inlet 68.

The white liquor and oxygen are brought into intimate contact by contacting elements which are preferably formed by beds of structured packing designated by reference numeral 74. As would be known by those skilled in the art, liquid distributors would be located between pairs of beds. The white liquor is introduced into structured packing 74 by a liquid distributor 76 and the oxygen rises through the open area of structured packing 74. Structured packing is efficient and has a very low pressure drop. This allows the recycling of the gas stream with a blower or an eductor. It is to be noted that to preclude clogging of the packing by particulates, the packing type and crimp angle are important. In this regard, structured packing 74 can have a packing density of between about 500 $m^2/m^3$ and is preferably Koch Type 1X or 1Y which can be obtained from Koch Engineering Company, Inc. of Wichita, Kansas. Random packing and trays could also be used with less effectiveness.

Column 64 should be operated at a pressure of no less than 9.2 atmospheres absolute. The oxygen should have a purity as high as is economical with 90% and above being preferred. The reaction should proceed at a total pressure of no less than about 9.2 atmospheres absolute and more preferably at least about 11.2 atmospheres absolute. Additionally, the reaction between the oxygen and the sodium sulfide should occur at a minimum temperature of about 110° C. A minimum reaction temperature of about 120° C. is more preferred and reaction temperatures at or above 150° C. are particularly preferred. A particularly preferred temperature and pressure is about 200° C. and about 18 atmospheres absolute.

The reaction of oxygen and sodium sulfide is an exothermic reaction. However, to start the reaction heat must be added to the white liquor to raise it to the requisite reaction temperature. To this end, a heat exchanger 78 can be provided before inlet 66 in which the incoming white liquor is heated by indirect heat exchange with steam. After the reaction progresses, heat exchanger 78 can be shut down.

The oxidized white liquor collects as a column bottom 80 within bottom region 72 of column 64. A product stream 82 of the oxidized white liquor is removed from bottom region 70 of column 64 and divided into first and second fully oxidized white liquor streams 32 and 38. At the same time, an oxygen containing tower overhead collects within top region 70 of column 64.

Tower overhead stream is circulated by an eductor 82 having a low pressure inlet 84, a high pressure outlet 86, and a high pressure inlet 88. A stream of in-process white liquor is pumped by a pump 90 through eductor 82. Low pressure inlet 84 of eductor 82 draws the tower overhead stream from top region 70 of column 64. The pumped oxidized white liquor is introduced into a high pressure inlet 88 of eductor 82 and a combined stream of tower overhead and oxidized white liquor is discharged from high pressure outlet 86 of eductor 82. High pressure outlet 86 is connected by a conduit 92 to bottom region 70 of column 64 in order to circulate the oxygen-containing column overhead back into bottom region 70.

Stripped gas impurities and reaction products which may serve to dilute the tower overhead stream and thereby lower oxygen partial pressure can collect at the top of column 64. In order for such gas impurities and reaction products to not affect the reaction, they can be periodically or continually vented through the use of a small vent 94 provided for such purpose.

The following are examples of the method of the present invention as carried out in FIGS. 1 and 2.

EXAMPLE 1

The following is an example of a practice of the invention in accordance with the embodiment illustrated in FIG. 1. For purposes of the examples set forth herein it is assumed that the white liquor has the following composition:

| Unoxidized White Liquor (UWL) Composition | | |
|---|---|---|
| | g/L as salt | g/L as sulfur |
| $Na_2S$ | 40 | 16.4 |
| NaOH | 100 | — |
| $Na_2CO_3$ | 33.7 | — |
| $Na_2S_2O_3$ | 1.3 | 0.5 |
| $Na_2S_x$ | 0 | — |
| $Na_2SO_4$ | 1.0 | 0.2 |
| Total | 176 | 17.1 |

In the following discussion, the term "kg/mtpd pulp" means kilograms per metric ton per day of oven dried wood pulp being processed. In this Example 1, about 333 kg/mtpd pulp of white liquor is introduced into polysulfide reaction stage 42. Additionally, 813 kg/mtpd pulp of white liquor is divided so that subsidiary stream 54 flows at about 250 kg/mtpd pulp and subsidiary stream 56 flows at approximately 563 kg/mtpd pulp to supply white liquor and complete white liquor oxidizing stages 46 and 48. Polysulfide reaction stage 42 in this example operates at approximately 80° C. and at 1 atm and produces 20 kg/mtpd pulp of polysulfide expressed as sulfur.

The typical composition of the polysulfide liquor, expressed in grams/liter salt or grams/liter sulfur is as follows:

| | Grams/Liter as Sulfur | Grams/Liter as Salt |
|---|---|---|
| $Na_2S_x$ | 5.0 | — |
| NaOH | — | 100 |
| $Na_2CO_3$ | — | 33.7 |
| $Na_2SO_4$ | 1.0 | — |
| $Na_2S_2O_3$ | 2.0 | — |

The production of thiosulfate liquor and fully oxidized white liquor of partial and complete white liquor oxidizing stages 46 and 48 are roughly equal to the flow rates of white liquor entering these stages. The composition of the thiosulfate liquor and the fully oxidized white liquor is as follows when expressed in g/L as salt.

| | Thiosulfate Liquor | Fully Oxidized White Liquor |
|---|---|---|
| $Na_2S$ | 0.0 | 0 |
| NaOH | 100 | 85 |
| $Na_2CO_3$ | 33.7 | 33.7 |
| $Na_2SO_4$ | — | 73 |
| $Na_2S_2O_3$ | — | <1.0 |

All of the thiosulfate liquor is utilized in oxygen delignification stage 20 while about 188 kg/mtpd pulp of the fully oxidized white liquor is used in extractive oxidation stage 30 with peroxide and about 375 kg/mtpd pulp of fully oxidized white liquor is used in a final peroxide bleaching stage 36. An ozone generator (not illustrated) is required to produce a mixture of about 10 kg/mtpd pulp of ozone and 73 kg/mtpd pulp of oxygen. In ozone bleaching stage 26, roughly 0.2% of the ozone is lost and waste stream 29 has the following approximate composition:

| WL for Ozone Stage off-gas Cleaning<br>Typical composition on a weight percent basis | |
|---|---|
| Oxygen | 83% |
| $O_3$ | 0.2% |
| CO | 30–40 ppm |
| $CO_2$ | 8–9% |
| $H_2O$ | satd at 40° C. |
| Organics | <10 ppm |

All of waste stream is introduced into polysulfide reaction stage 42 which in turn uses about 14.9 kg/mtpd pulp of oxygen. Scrubbed stream 44 contains approximately 58 kg/mtpd pulp of oxygen, approximately 30 ppm carbon monoxide and water saturated at 80° C. Scrubbed stream 44 is compressed in compressor 45 to between about 100 and 150 psig and approximately 25 kg/mtpd pulp of oxygen is introduced into oxygen delignification stage 20, about 5 kg/mtpd pulp of oxygen is introduced into the extractive oxidative stage 30. Approximately 4.9 kg/mtpd pulp of oxygen is introduced into the partial white liquor oxidation stage 46 and about 22.2 kg/mtpd pulp of oxygen is introduced into the complete white liquor oxidizing stage 48. The result of this is about 72 kg/mtpd pulp of oxygen is consumed and about 1 kg/mtpd pulp of oxygen is lost or vented from the process.

As can be seen from this example, a major advantage of the present invention is that most of the oxygen can be recycled back into the pulp bleaching apparatus and process if the waste stream 29 is first introduced into polysulfide reaction stage 42. Polysulfide reaction stage 42 will scrub carbon dioxide from waste stream 30 while consuming some of the oxygen. This will produce a lesser volume to be compressed by compressor 45 which is an advantage to be realized in lower power consumption.

EXAMPLE 2

Example 1 has particular application to white liquor that does not have too high a sulfidity. When sulfidity is high, the carbonic acid formed in the polysulfide reactor due to the presence of carbon dioxide will tend to neutralize the alkalinity of the polysulfide. In such case, the waste stream is scrubbed by a scrubber as illustrated in FIG. 2. In this example the flow rates of the various sodium hydroxide streams and oxygen containing streams will be the same as in the previous example. The main difference is that more white liquor will be needed to scrub waste stream 29. In this regard, 1,266 kg/mtpd pulp of white liquor is consumed in this example as compared with 1146 kg/mtpd pulp of white liquor in Example 1. The incoming white liquor is distributed so that about 933 kg/mtpd pulp of white liquor is used in white liquor oxidation (white liquor and complete white liquor oxidizing stages 46 and 48) and again, about 333 kg/mtpd pulp of white liquor is utilized in polysulfide reaction stage 42. Approximately 370 kg/mtpd pulp of white liquor is introduced into partial white liquor oxidizing stage 46 and about 563 kg/mtpd pulp of white liquor is introduced again into complete white liquor oxidizing stage 48. About 126 mtpd pulp of white liquor is used in forming scrubbing stream 60.

While the invention has been illustrated with reference to a preferred embodiment, it will be understood by those skilled in the art that numerous additions, modifications, and omission may be made without departing from the spirit and scope of the present invention.

What is claimed is:

1. A method of producing bleached wood pulp comprising:

digesting wood chips in a digestion stage to produce brownstock pulp and weak black liquor;

washing the brownstock pulp and extracting the weak black liquor;

introducing the brownstock pulp, after having been washed, into sequential bleaching stages, including oxygen delignification and ozone bleaching stages, to produce a bleached wood pulp product;

the oxygen delignification stage utilizing an oxygen containing stream and the ozone bleaching stage utilizing an ozone/oxygen containing stream and producing a waste stream principally containing water vapor, carbon dioxide, ozone, and oxygen;

recovering the waste stream and scrubbing the waste stream with an aqueous, sodium sulfide and sodium hydroxide containing solution to remove ozone and carbon dioxide from the waste stream and thereby form a scrubbed stream; and forming the oxygen containing stream for use in the oxygen delignification stage from the at least part of the scrubbed stream.

2. The method of claim 1, wherein:

the waste stream is scrubbed by reacting white liquor and the waste stream in a polysulfide production stage to produce a polysulfide liquor stream and said scrubbed stream; and said polysulfide liquor stream is introduced into said digestion stage.

3. The method of claim 1, wherein:

said sequential stages further include extractive oxidation and either peroxide or chlorine dioxide bleaching stages;

a polysulfide stream is introduced into said digestion stage;

a thiosulfate liquor stream is introduced into said oxygen delignification stage;

said oxygen containing stream used in said oxygen delignification stage comprises a first oxygen containing stream;

a second oxygen containing stream along with a fully oxidized white liquor stream is introduced into said extractive oxidation stage;

an optional fully oxidized white liquor stream is optionally introduced into said peroxide beaching stage;

three subsidiary streams composed of white liquor and third, forth, and fifth oxygen containing streams are introduced into a polysulfide production stage and elevated pressure white liquor oxidation and complete white liquor oxidizing stages, respectively, a first of the three subsidiary streams reacted with the third oxygen containing stream in the polysulfide production stage to form the polysulfide liquor stream, a second of the three subsidiary streams reacted with the forth oxygen containing stream in said white liquor oxidation stage to form a thiosulfate liquor stream, and a third of said three subsidiary streams reacted with said fifth oxygen containing stream in said complete white liquor oxidizing stage to form fully oxidized and optional fully oxidized white liquor streams;

the scrubbed stream is divided into four other subsidiary streams the first and second oxygen containing streams are formed from two of said four other subsidiary streams and two of said third, fourth, and fifth oxygen containing streams are formed from a remaining two of said four other subsidiary streams so that one of said third, forth, and fifth oxygen containing streams is not formed from said remaining two of said four other subsidiary streams;

compressing either the scrubbed stream or the waste stream to an elevated pressure at which the elevated pressure white liquor and complete white liquor oxidizing stages operate; and utilizing the waste stream as the one of the third, forth, and fifth oxygen containing streams not formed from said remaining two of said four other subsidiary streams so that the oxygen present within said waste stream reacts with said white liquor to either produce said thiosulfate liquor, completely oxidized white liquor or polysulfide liquor and said white liquor simultaneously acts as said aqueous, alkaline solution to scrub said waste stream.

4. The method of claim 3 wherein:

said third oxygen containing stream comprises said waste stream so that said waste stream is scrubbed during production of said polysulfide liquor stream; and said scrubbed stream is compressed to said elevated pressure.

5. The method of claim 1, wherein:

said sequential stages further include extractive oxidation and either peroxide or chlorine dioxide bleaching stages;

a polysulfide stream is introduced into said digestion stage;

a thiosulfate liquor stream is introduced into said oxygen delignification stage;

said oxygen containing stream used in said oxygen delignification stage comprises a first oxygen containing stream;

a second oxygen containing stream along with a fully oxidized white liquor stream is introduced into said extractive oxidation stage;

an optional fully oxidized white liquor stream is optionally introduced into said peroxide beaching stage;

three subsidiary streams composed of white liquor and third, forth, and fifth oxygen containing streams are introduced into a polysulfide production stage and elevated pressure white liquor oxidation and complete white liquor oxidizing stages, respectively, a first of the three subsidiary streams reacted with the third oxygen containing stream in the polysulfide production stage to form the polysulfide liquor stream, a second of the three subsidiary streams reacted with the forth oxygen containing stream in said white liquor oxidation stage to form a thiosulfate liquor stream, and a third of said three subsidiary streams reacted with said fifth oxygen containing stream in said complete white liquor oxidizing stage to form fully oxidized and optional fully oxidized white liquor streams; the waste stream is scrubbed by a partial stream composed of either white liquor, the thiosulfate liquor, the completely oxidized white liquor, or the polysulfide liquor;

either the scrubbed stream or the waste stream is compressed to an elevated pressure at which the elevated pressure white liquor and complete white liquor oxidizing stages operate; and forming the first, second, third, forth and fifth oxygen containing streams from said scrubbed stream.

6. The method of claim 5, wherein:

said waste stream is scrubbed with thiosulfate liquor to produce said scrubbed stream and a white liquor stream;

said white liquor stream is recycled and combined with the three subsidiary streams composed of white liquor; and said scrubbed stream is introduced into said polysulfide stage and partially used in forming the polysulfide liquor stream and the remainder of said scrubbed stream is compressed to said operating pressure and divided into said first, second, forth, and fifth oxygen containing streams.

7. The method of claims 4, wherein said weak black liquor is reprocessed to produce the white liquor.

* * * * *